US005311266A

United States Patent [19]

Madea

[11] Patent Number: 5,311,266

[45] Date of Patent: May 10, 1994

[54] IMAGE FORMING APPARATUS HAVING PARTICLE MODULATOR

[75] Inventor: Masataka Madea, Konan, Japan

[73] Assignee: Brother Kogyo Kabushiki Kaisha, Nagoya, Japan

[21] Appl. No.: 994,327

[22] Filed: Dec. 21, 1992

[30] Foreign Application Priority Data

Feb. 20, 1992 [JP] Japan ..... 4-007151[U]

[51] Int. Cl.[5] ..... G03G 15/06

[52] U.S. Cl. ..... 355/261; 346/140 R; 346/159; 355/265

[58] Field of Search ..... 355/246, 247, 259, 261, 355/263, 265, 262, 251, 253; 346/140 R, 159, 157; 118/651, 652, 654

[56] References Cited

U.S. PATENT DOCUMENTS

| | | | |
|---|---|---|---|
| 3,689,935 | 9/1972 | Pressman et al. . | |
| 4,044,719 | 8/1977 | Ohmori | 118/652 |
| 4,439,781 | 3/1984 | Yano | 396/153.1 |
| 4,491,855 | 1/1985 | Fujii et al. . | |
| 4,794,878 | 1/1989 | Connors et al. | 118/653 |
| 5,157,226 | 10/1992 | Takahashi | 118/651 |
| 5,202,704 | 4/1993 | Iwao | 346/140 R |
| 5,204,719 | 4/1993 | Bares | 355/247 |
| 5,210,577 | 5/1993 | Nowak | 355/273 |
| 5,253,016 | 10/1993 | Behe et al. | 355/215 |

FOREIGN PATENT DOCUMENTS

| | | |
|---|---|---|
| 58-114974 | 7/1983 | Japan . |
| 62-248662 | 10/1987 | Japan . |

*Primary Examiner*—Grimley A. T.
*Assistant Examiner*—T. A. Dang
*Attorney, Agent, or Firm*—Oliff & Berridge

[57] ABSTRACT

An image forming apparatus is low priced and has a compact size. The apparatus is further capable of easily controlling toner particles such that the toner particles pass through individual apertures without a high-priced high-voltage A.C. power supply and a high-priced compressor. A driving roller and a shaft-type steel support preferably having a diameter of about 3 mm are arranged in a toner case so as to be parallel to each other. The driving roller and the support are bound by a belt preferably made of silicone rubber so as to be under tension. The belt is preferably formed about 200 mm thick, and a piezoelectric vibrator for vibrating the support is provided on the one end of the support.

21 Claims, 4 Drawing Sheets

IMAGE FORMING APPARATUS HAVING PARTICLE MODULATOR

BACKGROUND OF THE INVENTION

1. Field of the Invention

The present invention relates to an image forming apparatus used for a copier, a printer, a plotter and a facsimile, and more particularly, to an image forming apparatus having a particle modulator for controlling a flow of toner particles.

2. Description of the Related Art

An image forming apparatus having a particle modulator is disclosed in the U.S. Pat. No. 3,689,935. In the image forming apparatus, the particle modulator comprises an insulative layer, a reference electrode and a plurality of control electrodes. The reference electrode is one sheet formed on one side of the insulative layer. The control electrodes are independently formed on the other side of the insulative layer. Moreover, the particle modulator has apertures formed in at least one line. The apertures penetrate the above-mentioned three layers (the reference electrode, the insulative layer and the control electrode). The image forming apparatus further comprises a driving circuit for selectively applying a voltage between each of the control electrodes and the reference electrode, a toner particle supply device for supplying the charged toner particles toward the particle modulator, and a moving device for relatively moving a supporting member with respect to the particle modulator in a flow of the toner particles. In the image forming apparatus, the driving circuit selectively applies the voltage between each of the control electrodes and the reference electrode according to an image signal, thereby controlling the toner particles. Then, the toner particles pass through each of the apertures so that an image is formed on the supporting member.

There are three kinds of toner particle supply devices for supplying the charged toner particles to the vicinity of the apertures. According to the device disclosed in Japanese Laid-Open Patent Publication No. 62-248662, the toner particles are supplied to the vicinity of the apertures by rotation of a toner carry roller after the charged toner particles are held on the toner carry roller. Moreover, according to the device disclosed in U.S. Pat. No. 4,491,855, the charged toner particles are formed in a mist in an alternating electric field applied between a toner carrying member and a particle modulator and are supplied to the vicinity of the apertures. Further, according to the device disclosed in Japanese Laid-Open Patent Publication No. 58-114974, the charged toner particles are supplied to the vicinity of the apertures according to an air flow.

However, in the toner particle supply device employing the toner carry roller for supplying the toner particles to the vicinity of the apertures, an image-force and van der Waals forces by which the toner particles are held on the toner carry roller are comparatively great. Therefore, it is difficult to supply a sufficient amount of toner particles toward the vicinity of the apertures with certainty. On the other hand, there is a need to form an electric field having a strong magnetic force in order to draw the toner particles from the toner carry roller and in order to make the toner particles pass through each of the apertures. Thus, since there is a need to provide a high-voltage power supply in the image forming apparatus, the image forming apparatus becomes expensive.

Moreover, in the toner particle supply device employing an alternating electric field, there is a need to provide a high-priced high-voltage A.C. power supply. Therefore, the image forming apparatus becomes expensive. Further, the alternating electric field disturbs a control electric field which controls the toner particles such that the toner particles pass through each of the apertures, thereby forming an unclear image.

In the toner particle supply device employing an air flow, there is a need to provide a compressor for generating the air flow. Therefore, the image forming apparatus becomes complicated and expensive.

SUMMARY OF THE INVENTION

It is therefore an object of the present invention to provide a low-priced image forming apparatus without an expensive high-voltage A.C. power supply and an expensive compressor.

Another object of the present invention is to provide an image forming apparatus capable of supplying sufficient toner particles toward a particle modulator, thereby forming a clear image.

To achieve these and other objects, the image forming apparatus comprises; a toner particle supply means for supplying the charged toner particles; a particle modulating means wherein a plurality of apertures are formed for controlling the flow of the charged toner particles supplied by the toner particle supply means in order to form an image on a supporting member with the toner particles passed through the apertures; a belt driving roller provided in the toner particle supply means and disposed opposite to the particle modulating means; a supporting bar disposed opposite to the apertures of the particle modulating means and extending so as to be parallel to the belt driving roller; a toner carrying belt bound on the belt driving roller and the supporting bar; and a vibrating means for vibrating the supporting bar.

In the image forming apparatus having the above-mentioned structure, when the supporting bar is vibrated by the vibrating means, a part of the toner carrying belt which is supported by the supporting bar is vibrated. Therefore, the toner particles held on the toner carrying belt and carried to the vicinity of the apertures of the particle modulator are vibrated through the supporting bar. Then, the toner particles are freed from adhesion, such as the image-force and the van der Waals forces, and supplied to the apertures. The toner particles supplied to the particle modulator are controlled by the particle modulator so as to pass through each of the apertures. Thus, an image is formed on the supporting member with the toner particles which passed through the apertures As described above, according to the present invention, it is possible to provide an image forming apparatus which has a low price and a compact size, and which is capable of easily controlling the toner particles such that the toner particles pass through each of the apertures without an expensive high-voltage A.C. power supply and an expensive compressor.

DETAILED DESCRIPTION OF PREFERRED EMBODIMENTS

Figure 1:
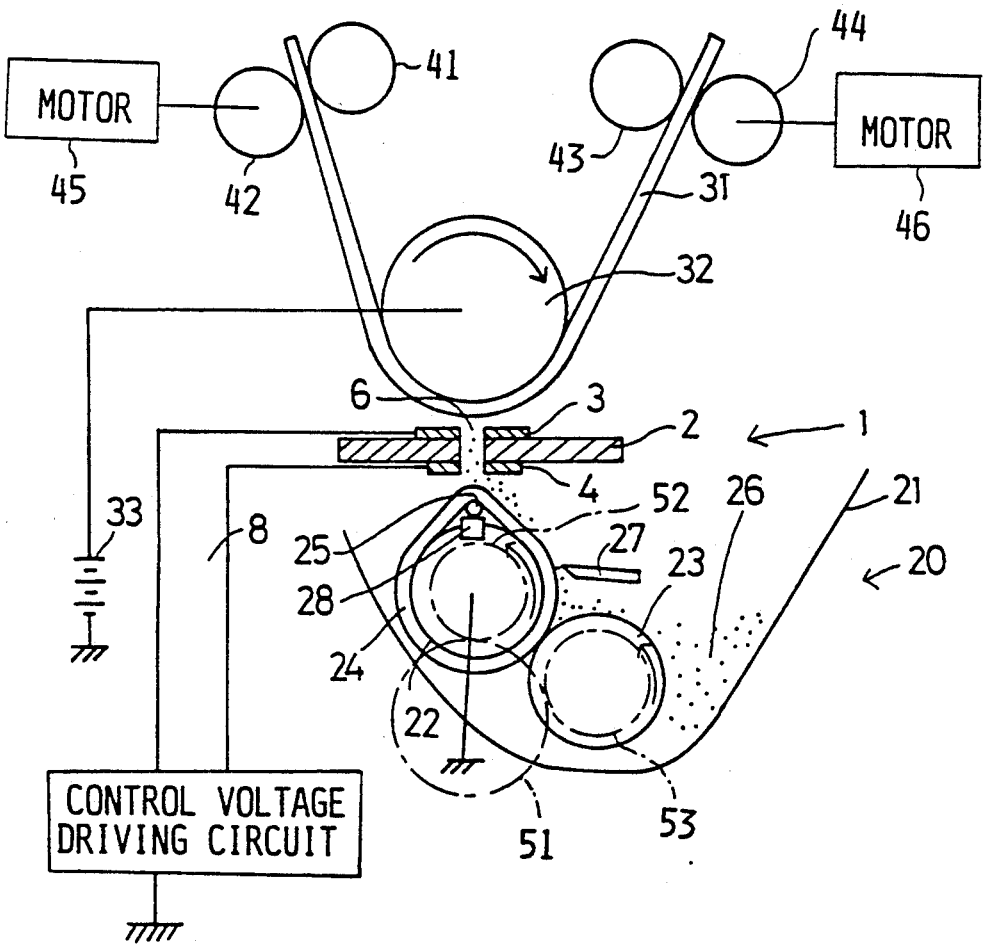
FIG. 1 is a schematic side view of an image forming apparatus of the present embodiment.

Hereinafter, an embodiment of the present invention will be explained with reference to the figures.

First, the structure of the image forming apparatus of the present embodiment will be explained with reference to FIGS. 1 and 2. An electrode roller 32 is rotatably provided above a particle modulator A supporting member 31, such as paper, is fed by a pair of feeding rollers 41 and 42 driven by a motor 45 and a pair of feeding rollers 43 and 44 driven by a motor 46. The electrode roller 32 is connected to a positive A.C. power supply 33. A toner particle supply device 20 is provided under the particle modulator 1.

The toner particle supply device 20 comprises toner particles 26, a driving roller 22 and a shaft-type support 25 which are arranged in a toner case 21. The driving roller 22 preferably has a diameter of about 30 mm. The support 25 preferably has a diameter of about 3 mm and is made of steel. The support 25 is disposed so as to be parallel to the driving roller 22. The driving roller 22 and the support 25 are bound together by a belt 24 preferably made of silicone rubber and is under tension. The belt 24 is preferably formed about 200 mm thick. Piezoelectric vibrators 28 and 34 are located on the both ends of the support 25, respectively. A vibrator circuit 30 which applies the voltage for the predetermined number of vibrations to the piezoelectric vibrator 28, is connected to the piezoelectric vibrator 28. The piezoelectric vibrator 34 changes the mechanical vibration applied to the support 25 by the piezoelectric vibrator 28 into voltage. The voltage generated by the piezoelectric vibrator 34 is consumed by a resistor 35. Therefore, a reflected wave does not generate on the support 25. Further, a standing wave is prevented from generating on the support 25.

The belt 24 is sandwiched between the driving roller 22 and a supplying roller 23 formed to be parallel to the driving roller 22. A toner control blade 27 is disposed to come in contact with the belt 24 on the driving roller 22. The driving roller 22 is connected to a motor 50 through gears 52 and 51. The supplying roller 23 is connected to the motor 50 through gears 53 and 51. Therefore, the driving roller 22 and the supplying roller 23 are rotated in the same direction by the motor 50.

Figure 2:
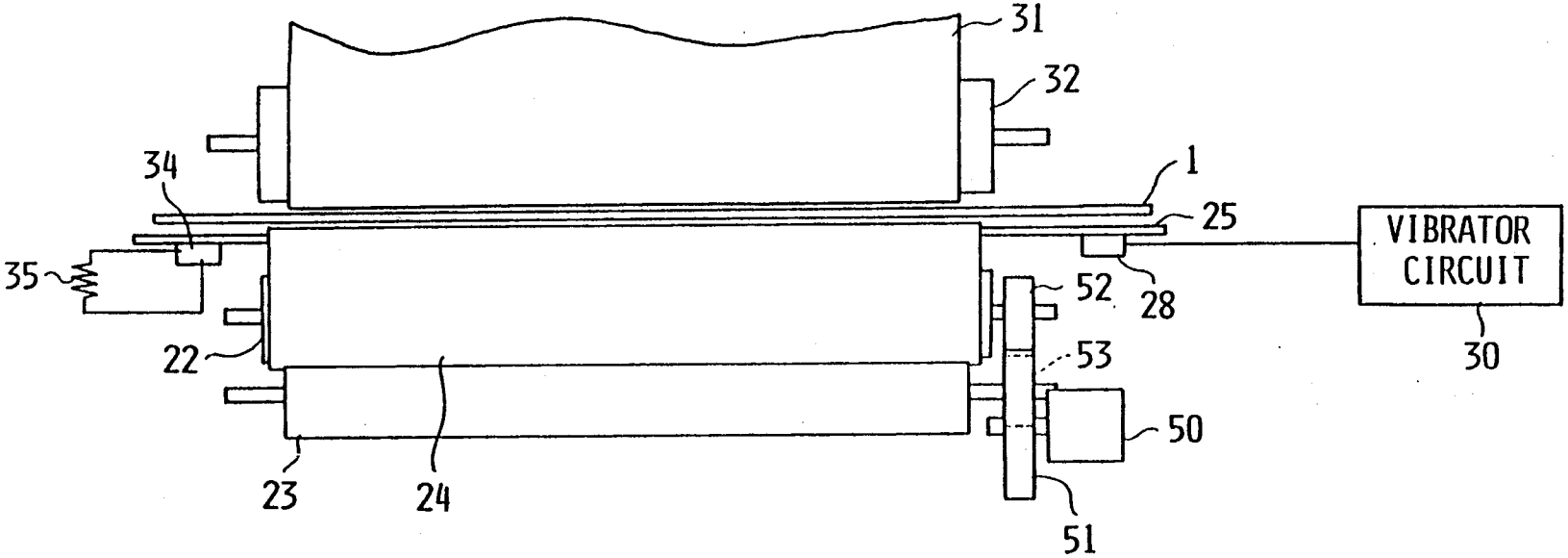
FIG. 2 is an elevational schematic view of the internal structure of the image forming apparatus of FIG. 1.
Figure 3:
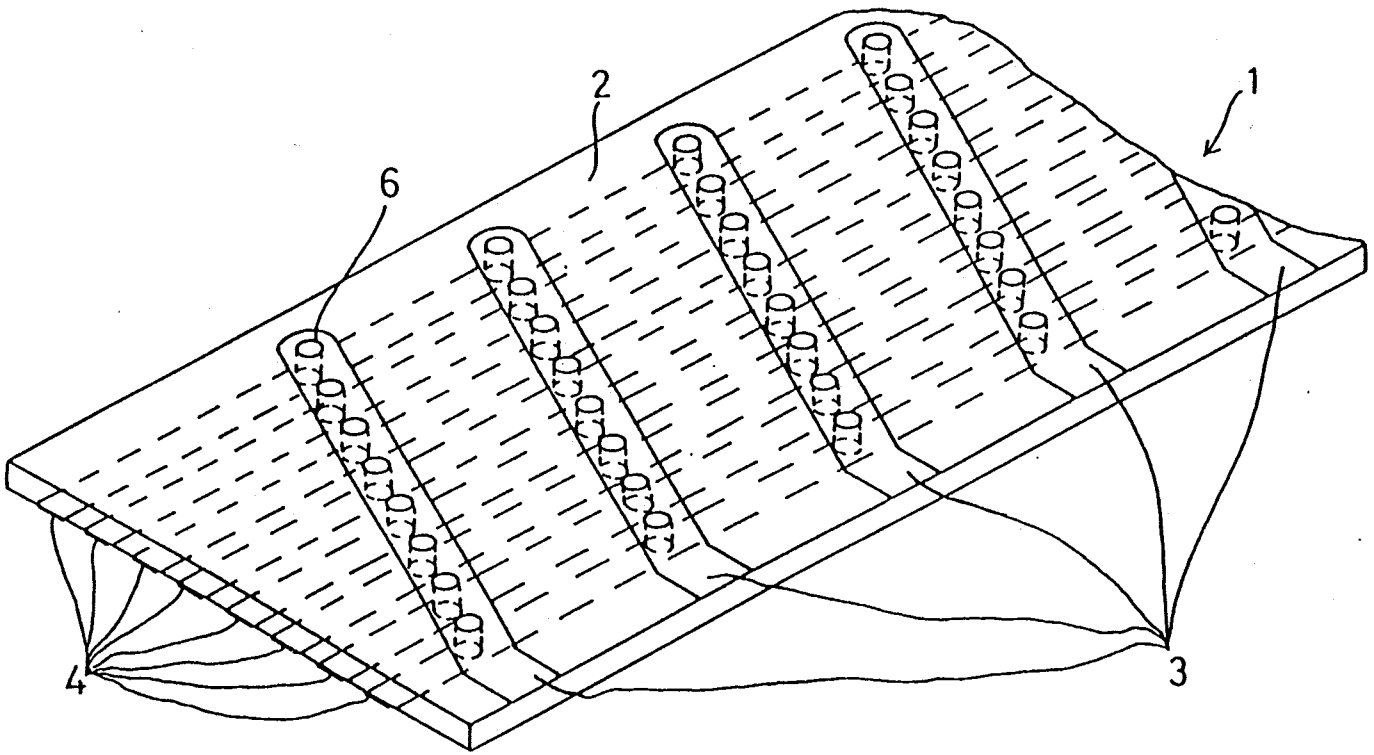
FIG. 3 is a partial perspective view showing a particle modulator in detail.

As shown in FIG. 1, the particle modulator 1 comprises an insulative sheet 2 preferably made of polyimide, a plurality of data electrodes 3 formed on one side of the insulative sheet 2 and eight scan electrodes 4 formed on the other side of the insulative sheet 2 in the longitudinal direction. Since each of the data electrodes 3 is formed at a slant with respect to the cross direction of the particle modulator as shown in FIG. 3, the data electrodes 3 and the scan electrodes 4 intersect each other so as to form slanting cross stripes. An aperture 6 is formed at each intersection of the data electrode 3 and the scan electrode 4 so as to penetrate the data electrode 3, the insulative sheet 2 and the scan electrode 4. The data electrodes 3 and the scan electrodes 4 are respectively connected to a control voltage driving circuit 8 for generating an electric field in each of the apertures 6 according to an image signal.

Next, the operation of the image forming apparatus will be explained. The driving roller 22 and the supply roller 23 rotate in the direction shown by each arrow in FIG. 1. Then, the toner particles 26 held on the supply roller 23 are rubbed between the belt 24 wound on the driving roller 22 and the supply roller 23 so as to be negatively charged. The charged toner particles 26 are thus held on the belt 24. After this, the toner particles 26 are smoothed with the toner control blade 27 and carried toward the support 25 by a rotation of the driving roller 22. At this time, the support 25 is vibrated by way of the piezoelectric vibrator 28 in the axial direction, so that the belt 24 disposed opposite to the apertures 6 is vibrated. Then, the toner particles 26 held on the belt 24 are shaken off, that is, the toner particles 26 are freed from the adhesion with the belt 24, and are supplied to the scan electrodes 4 side of the aperture electrode 1.

Now, the control voltage driving circuit 8 applies a voltage of about 50 V, for example, to one out of eight of the scan electrodes and applies a voltage of about 250 V, for example, to the others. According to the image data, the control voltage driving circuit 8 applies a voltage of about 200 V or 0 V, for example, to each data electrode 3.

If the apertures 6 of the scan electrode 4 which has the voltage of 50 V applied thereto correspond to the apertures 6 of the data electrodes 3 which have the voltage of 200 V applied thereto, an electric line of force which extends from the data electrode 3 side to the scan electrode 4 side is formed in each of these apertures 6. Then, the negatively charged toner particles 26 are attracted from the scan electrode 4 side toward the data electrode 3 side. Further, the toner particles 26 are transferred onto the supporting member 31 according to the transferring electric field formed by the electrode roller 32. Thus, the toner particles 26 form dots on the supporting member 31. On the other hand, if the data electrodes 3 are applied a voltage of 0 V, an electric line of force which extends from the scan electrode 4 side to the data electrode 3 side is formed in each of these apertures 6. Therefore, the negatively charged toner particles 26 are not attracted from the scan electrode 4 side to the data electrode 3 side. Thus, the toner particles 26 do not pass through each of the apertures 6.

The scan electrode 31 having the voltage of 50 V applied thereto by the control voltage driving circuit 8 is determined in sequence as time elapses. The data electrodes 3 corresponding to the scan electrode 31 having the voltage of 50 V applied thereto have the voltage of 200 V or 0 V applied thereto according to the image signal, thereby forming dots in one line after another.

After all the scan electrodes 4 have the voltage of 50 V applied in sequence, the supporting member 31 is moved up by one dot, that is, in the diameter of the aperture 6 toward the direction perpendicular to the extending direction of the scan electrodes 4. The above-mentioned operation is repeated until a toner image is formed on the supporting member 31.

As described above, according to the present embodiment, it is possible to provide an image forming apparatus which has a low price and a compact size, and which is capable of easily controlling the toner particles such that the toner particles pass through each of the apertures without the expensive high-voltage A.C. power supply and the expensive compressor.

Figure 4:
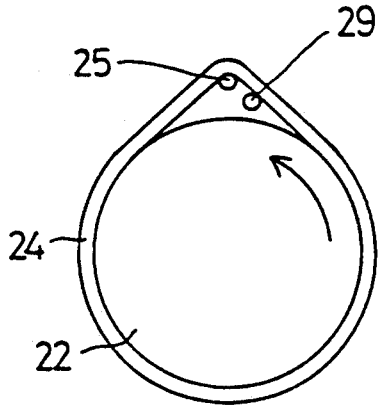
FIG. 4 is a schematic side view showing the location of a shaft support member of another embodiment.

For example, as shown in FIG. 4, a damper 29 made of rubber is provided downstream of the support 25 with respect to the moving direction of the belt 24. In this case, the vibration of the belt 24 is absorbed or reflected by the damper 29 in order to limit the vibrating area of the belt 24. Thus, a high-density mist of the toner particles is applied to the vicinity of the apertures.

Moreover, the particle modulator i is disposed so as to come in contact with the belt 24 through the toner particles 26 on the belt 24. The vibration of the support 25 travels the belt 24 and toner particles 26 on the belt or air, and further travels the particles modulator Then, the particle modulator is vibrated. Since the toner particles are prevented from adhering onto the toner particle modulator 1 by the vibration, the apertures are not clogged with the toner particles.

This invention is not limited to the above mentioned embodiment. It should be understood that many changes and modifications may be made in the embodiment without departing from the scope of the present invention as defined in the appended claims.

What is claimed is:

1. An image forming apparatus comprising:

toner supply means for supplying toner to a support member to form an image thereon; and a particle modulator means disposed adjacent to said toner supply means for controlling the supply to toner particles from said toner supply means to the support member, wherein said toner supply means comprises a toner supply for supplying charged toner particles, a toner carrying member for carrying the toner particles supplied from said toner supply and vibration means for vibrating said toner carrying member to release the toner particles carried thereon, said vibration means including a support in contact with said toner carrying member and a vibrator coupled to said support.

2. The image forming apparatus of claim 1, wherein said particle modulator means comprises an insulative member with a first side and a second side, said first side having a plurality of data electrodes thereon and said second side having a plurality of scan electrodes thereon, said data electrodes and said scan electrodes arranged in a pattern having a plurality of intersecting points with apertures formed in said insulative member at each intersecting point, and further comprising a control voltage means coupled to said data electrodes and said scan electrodes for creating an electric field therebetween.

3. The image forming apparatus of claim 1, further comprising an electrode roller for carrying the support member thereon.

4. The image forming apparatus of claim 1, wherein said toner carrying member includes a driving roller having an axis of rotation and a belt secured around said driving roller, and said vibration means includes an elongate member having a longitudinal axis generally parallel to said axis of rotation, said belt extending around said elongate member to retain said elongate member adjacent said roller.

5. The image forming apparatus of claim 1, wherein said vibration means includes a shaft, a vibrator secured thereto and a vibrating circuit connected to said vibrator for applying voltage to said vibrator for vibrating said shaft, said shaft being in contact with said toner carrying member.

6. The image forming apparatus of claim 5, where said toner carrying member includes a belt and said shaft is disposed in contact with said belt for vibrating said belt.

7. The image forming apparatus of claim 6, wherein said toner carrying member further includes a driving roller and said belt is disposed in tension around said driving roller and said shaft.

8. The image forming apparatus of claim 7, further comprising an elongate rubber shaft disposed in contact with said belt to dampen vibrations in said belt.

9. The image forming apparatus of claim 1, wherein support is an elongate member having two ends and said vibrator is secured at one of said ends.

10. The image forming apparatus of claim 9, further comprising a control vibrator secured to the other of said ends to dampen the vibration in said elongate member.

11. The image forming apparatus of claim 10, wherein said control vibrator is a piezoelectric vibrator that converts the vibration into voltage and includes a resistor to absorb the voltage.

12. The image forming apparatus of claim 1, comprising damper means disposed adjacent but from said vibration means for damping vibrations in 13. The image forming apparatus of claim 12, in said damper means comprises a rubber member.

14. A toner supply assembly for supplying toner to a support member in an image forming apparatus, comprising:

a toner carrying member for carrying charged toner particles;

a toner supply adjacent said toner carrying member for supplying the charged toner particles to said toner carrying member; and a vibration mechanism including a support coupled to said toner carrying member and including a vibrator coupled to said support that vibrates said toner carrying member to release the toner particles carried thereon.

15. The toner supply assembly of claim 14, wherein said support is an elongate member in contact with said toner carrying member.

16. The toner supply assembly of claim 14, wherein said toner carrying member further includes a driving roller and a belt, said belt being disposed in tension around said driving roller and said support.

17. The toner supply assembly of claim 14, wherein said support is an elongate member having two ends and said vibrator is secured at one of said ends.

18. The toner supply assembly of claim 17, further comprising a control vibrator secured to the other of said ends to dampen the vibration in said elongate member.

19. The toner supply assembly of claim 18, wherein said control vibrator is a piezoelectric vibrator that converts the vibration into voltage and includes a resistor to absorb the voltage.

20. The toner supply assembly of claim 14, further comprising damper means disposed adjacent but spaced from said vibration means for damping vibrations in said toner carrying member.

21. An image forming apparatus comprising:

a toner particle supply means for supplying charged toner particles, including a belt driving roller and a toner carrying belt bound on said belt driving roller;

a particle modulating means having a plurality of apertures for controlling flow of the charged toner particles supplied by said toner particle supply means through said apertures in order to form an image on a supporting member from the toner particles which flow through said apertures;

a supporting bar disposed opposite to said apertures of said particle modulating means, extending parallel to said belt driving roller and being bound to said belt driving roller by said toner carrying belt; and vibrating means for vibrating said supporting bar.

* * * * *

UNITED STATES PATENT AND TRADEMARK OFFICE

CERTIFICATE OF CORRECTION

PATENT NO. : 5,311,266

DATED : May 10, 1994

INVENTOR(S) : Masataka MAEDA

It is certified that error appears in the above-identified patent and that said Letters Patent is hereby corrected as shown below:

On the Title Page, under item [19] "Madea" should read --Maeda-- and in [75] change "Masataka Madea" to --Masataka Maeda--.

Signed and Sealed this

Twenty-third Day of August, 1994

*Attest:*

Bruce Lehman

BRUCE LEHMAN

*Attesting Officer*

*Commissioner of Patents and Trademarks*